US010880957B2

(12) United States Patent
Schlipf

(10) Patent No.: US 10,880,957 B2
(45) Date of Patent: Dec. 29, 2020

(54) INTERNAL STRUCTURE FOR AN ELECTRICAL HEATING DEVICE WITH HEATING ELEMENT FREELY COILED AT LEAST IN SECTIONS AND ELECTRICAL HEATING DEVICE

(71) Applicant: Türk & Hillinger GmbH, Tuttlingen (DE)

(72) Inventor: Andreas Schlipf, Tuttlingen (DE)

(73) Assignee: TÜRK & HILLINGER GMBH, Tuttlingen (DE)

( * ) Notice: Subject to any disclaimer, the term of this patent is extended or adjusted under 35 U.S.C. 154(b) by 252 days.

(21) Appl. No.: 15/990,280

(22) Filed: May 25, 2018

(65) Prior Publication Data

US 2018/0352610 A1 Dec. 6, 2018

(30) Foreign Application Priority Data

Jun. 6, 2017 (DE) ..... 20 2017 103 387

(51) Int. Cl.

| | |
|---|---|
| ***H05B 3/44*** | (2006.01) |
| ***H05B 3/46*** | (2006.01) |
| ***H05B 3/16*** | (2006.01) |
| ***H05B 3/06*** | (2006.01) |
| *H05B 3/02* | (2006.01) |

(52) U.S. Cl.

CPC ..... *H05B 3/44* (2013.01); *H05B 3/06* (2013.01); *H05B 3/16* (2013.01); *H05B 3/46* (2013.01); *H05B 2203/002* (2013.01)

(58) Field of Classification Search

CPC ... H05B 3/04; H05B 3/06; H05B 3/10; H05B 3/16; H05B 3/42; H05B 3/44; H05B 3/46; H05B 3/48; H05B 3/64; H05B 3/78; H05B 3/80; H05B 2203/002; H05B 2203/032

USPC ..... 219/408, 481, 520, 523, 525, 532, 538, 219/539, 541, 542, 544, 550, 552, 553

See application file for complete search history.

(56) References Cited

U.S. PATENT DOCUMENTS 1,407,918 A * 2/1922 Bernard ..... H05B 3/00 219/542
1,618,364 A * 2/1927 Clark ..... H05B 3/16 219/536

(Continued)

FOREIGN PATENT DOCUMENTS

DE 102013212205 A1 12/2014
EP 2296433 B1 3/2011

*Primary Examiner* — Hung D Nguyen

(74) *Attorney, Agent, or Firm* — Panitch Schwarze Belisario & Nadel LLP

(57) ABSTRACT

An internal structure for an electrical heating device includes an electrical heating element. The internal structure includes a connection section for holding an end section of the electrical heating element or a connecting wire, with which one of the two end sections is connected. A turnaround section is positioned opposite the connection section. A spacer runs between the connection section and the turnaround section and is topped by the turnaround section in a radial direction relative to the profile of the spacer. The turnaround section has, for a turned-around electrical heating element or for a turned-around connecting wire in the area topping the spacer, a connecting bar by means of which the electrical heating element or the connecting wire is guided and thus turned around, with this connecting wire being connected to an end section.

15 Claims, 4 Drawing Sheets

(56) References Cited

U.S. PATENT DOCUMENTS

| | | | | |
|---|---|---|---|---|
| 2,888,546 | A * | 5/1959 | Kinney | H05B 3/80<br>392/441 |
| 2002/0047002 | A1* | 4/2002 | Wheeler | H05B 3/44<br>219/243 |
| 2007/0235444 | A1* | 10/2007 | Lewin | H05B 3/44<br>219/602 |
| 2011/0184502 | A1* | 7/2011 | Bruder | A61F 7/007<br>219/494 |
| 2015/0001206 | A1 | 1/2015 | Schlipf | |

* cited by examiner

INTERNAL STRUCTURE FOR AN ELECTRICAL HEATING DEVICE WITH HEATING ELEMENT FREELY COILED AT LEAST IN SECTIONS AND ELECTRICAL HEATING DEVICE

CROSS-REFERENCE TO RELATED APPLICATIONS

This application claims priority under 35 U.S.C. § 119(b) to German Patent Application No. 20 2017 103 387, filed Jun. 6, 2017, the disclosure of which is incorporated herein by reference in its entirety.

BACKGROUND OF THE INVENTION

Many electrical heating devices have tubular metal sheathings, in whose interior an electrical heating element is arranged, which is typically fixed in its position after its arrangement in the interior of the tubular metal sheathing by the interspersing and optional compacting of a powder or granulate that has, in particular, electrically insulating properties, and insulated electrically from the tubular metal sheathing if the electrical heating element itself is already not electrically insulated on its outer side.

The manufacture of such electrical heating devices is then particularly simple if the electrical heating element is provided as a separate assembly, which is preconfigured, in particular, for its arrangement in space, it is inserted into the interior of the tubular metal sheathing and then the powder or granulate can be interspersed. A common approach for reducing this concept to practice consists in winding the electrical heating element constructed, e.g., as heating wire or resistive wire, on a coil form that can be made, e.g., from ceramic, and then using this coil form as the preconfigured internal structure for the electrical heating device. However, this solution loses a considerable amount in terms of degrees of freedom for the spatial arrangement of the electrical heating element.

The applicant has already earlier developed two alternative approaches that enable it to provide the electrical heating element as a separate, preconfigured assembly in which the coil form limiting the degrees of design freedom can be avoided. In one case, as disclosed in German Patent Application No. DE 10 2013 212 205 A1, the applicant developed electrical heating devices in which a self-supporting electrical heating conductor is used that can be shaped freely to a desired spatial curve and inserted into the interior of the tubular metal sheathing. Naturally, however, this arrangement is associated with a certain minimum cross-section of the electrical heating conductor, which limits the resistance per unit of length that can be achieved.

In the other case, as described, e.g., in European Patent No. EP 2 296 433 B1, the applicant developed electrical heating devices that use tubular heating bodies or coiled tube cartridges as the electrical heating element, in which the required dimensional stability to be able to use these heating elements as preconfigured internal structures is achieved by the metal sheathings of these electrical heating elements. As a result, however, this produces relatively large spatial requirements for the electrical heating element, so it cannot be used in all cases.

BRIEF SUMMARY OF THE INVENTION

The preferred invention is applied to this situation; its problem is to provide an internal structure for an electrical heating device that makes it possible to provide electrical heating elements, especially heating wires or resistive wires, freely coiled at least in sections as preconfigured assemblies, which are inserted into the interior of a tubular metal sheathing, in which electrically insulating powder or granulate can be embedded and optionally compacted and to also provide an electrical heating device with such an internal structure.

As used herein, the phrase "freely coiled at least in sections" will be understood to mean that at least along some sections of the electrical heating element in the shape of a coil, the coil is unsupported radially, such as by a coil form, bobbin or other internal or external support.

This problem is solved by an internal structure for an electrical heating device having an electrical heating element freely coiled at least in sections with the features of a connection section, a turnaround section and a spacer. The connection section is for holding one of two end sections of the electrical heating element freely coiled in sections and/or at least one connecting wire, with which at least one of the two end sections of the electrical heating element freely coiled at least in sections is connected. The turnaround section is arranged opposite the connection section and at which the electrical heating element freely coiled at least in sections and/or the at least one connecting wire is turned around, with the at least one connecting wire being connected to at least one of the two end sections of the electrical heating element freely coiled at least in sections is connected. The spacer runs between the connection section and the turnaround section and is topped at least by the turnaround section at least in a radial direction relative to a profile of the spacer, wherein the turnaround section has, for at least one turned-around electrical heating element and/or for at least one turned-around connecting wire in an area topping the spacer at least in the radial direction relative to the profile of the spacer, a connecting bar by the electrical heating element freely coiled at least in sections and/or the at least one connecting wire is guided and thus turned around, with the at least one connecting wire being connected to at least one of the two end sections of the electrical heating element freely coiled at least in sections. A controller, a sensor or a detecting element is installed in the spacer or mounted on the spacer. Advantageous refinements of the invention are the subject matter of the dependent claims.

It is preferred in the invention that the turnaround section has, for at least one turned-around electrical heating element and/or for at least one turned-around connecting wire in the area topping the spacer in at least a radial direction relative to the profile direction of the spacer, a connecting bar by means of which the electrical heating element freely coiled at least in sections and/or the connecting wire is guided and thus turned around. The connecting wire is preferably connected to at least one of the two end sections of the electrical heating element freely coiled at least in sections. In particular, here "turned around" means a change in direction of approximately one hundred eighty degrees (180°), but other changes of direction are also possible.

The phrase "in the radial direction" preferably means "in at least a radial direction," thus it does not imply mandatory radial symmetry, but instead in the sense of a description of the geometry of the internal structure under use of a cylindrical geometry or a cylindrical coordinate system in which the axis is specified by the—optionally local—profile direction of the spacer between the connection section and the turnaround section and the other coordinates are the radius, that is the distance from this axis, and a polar angle.

It is explicitly noted that the turnaround section of the electrical heating element does not necessarily have to be freely coiled, but instead could also be, e.g., a connection section. This makes it possible to realize, just like the alternative of the turnaround of a connecting wire according to the preferred invention, internal structures in which freely coiled sections of the electrical heating element can be provided not only in pairs, that is, in even numbers, but if necessary or desired also in odd numbers.

The internal structure thus forms a support structure that holds the coiled heating wire sections under the desired mechanical stress and specifies its arrangement in space. The internal structure can then be inserted into a tubular metal sheathing of an electrical heating device or a load resistor and filled with electrically insulating powder or granulate.

According to one advantageous refinement of the internal structure for an electrical heating device, it can be provided that at least one turnaround section has, for a turned-around electrical heating element and/or for a turned-around connecting wire, with which at least one of the two end sections of the electrical heating element freely coiled at least in sections is connected, a connecting bar running in the radial direction relative to the profile of the spacer that preferably runs parallel to an imaginary axis and preferably has, in particular, a center axis, by means of which the electrical heating element freely coiled at least in sections and/or the connecting wire is guided and therefore turned around, with this connecting wire being connected to at least one of the two end sections of the electrical heating element freely coiled at least in sections.

Here, preferred embodiments in which several ("n") connecting bars have a symmetrical design are especially preferred, so that an n-count rotational symmetry with respect to the axis running through the spacer, especially the center axis of the spacer, is produced. In this way, multiple freely coiled sections of electrical heating elements can be distributed uniformly around the circumference.

In addition, the radial profile of the connecting bars also simplifies the arrangement of the electrical heating elements on the connecting bars when assembling the internal structure.

It is further preferred if the electrical heating element and/or the turned-around connecting wire, with which at least one of the two end sections of the electrical heating element freely coiled at least in sections is connected, is supported on the connection section, so that a freely coiled section of the electrical heating element is tensioned. Here it is especially preferred if the stress can be varied by adjusting the support. This measure allows, especially for the production of the internal structure, to first easily guide the heating element without it being under mechanical stress over the turnaround section and then to fix it with the desired stress by holding its ends or connecting wires connected to one or both ends.

This is possible in an especially simple way if the connection section has at least one slot in which a section of the electrical heating element freely coiled at least in sections or a connecting wire is supported, because then the section to be supported can be easily inserted from one side into the slot.

If the turnaround section for at least one turned-around electrical heating element and/or for at least one turned-around connecting wire has a lug for preventing slippage of the turned-around electrical heating element and/or the turned-around connecting wire, keeping the electrical heating element in the desired position is guaranteed in a simple way.

The precise positioning of the internal structure in the electrical heating device according to one of the preferred invention can be easily, generally guaranteed if the connection section and/or the turnaround section has support surfaces for supporting the internal structure on the tubular metal sheathing of an electrical heating device.

If the position of the connection section and/or the turnaround section on the spacer is variable and there are fixing means for fixing the connection section and/or the turnaround section, on one hand, the desired mechanical stress of the electrical heating element and especially its freely coiled section can be easily adapted, and, on the other hand, advantages in the finishing of the internal structure for electrical heating devices of different length can also be achieved.

It is also possible that a connecting wire forms the spacer. This makes it possible, if preferred or necessary, to provide a configuration of the electrical heating elements, in which the freely coiled section of the electrical heating element describes a comparable spatial curve like for an electrical heating element coiled on a carrier.

The internal structure constructed according to the preferred invention for an electrical heating device also has, with the spacer, an ideally suitable position in which a controller, a sensor, or a detecting element is installed or on which the controller, the sensor, or the detecting element can be mounted.

In particular, the internal structure can also be shaped so that multiple electrically heating elements freely coiled at least in sections are arranged on it. This arrangement provides a large amount of flexibility with respect to the provided heat output, which can be increased even more if at least some of the multiple electrical heating elements freely coiled at least in sections are galvanically separated and/or have a different heat output and/or can be switched individually.

Furthermore, for a refinement of the internal structure for an electrical heating device it can be provided that at least one electrical heating element freely coiled at least in sections is connected in series with a thermal fuse.

The electrical heating device according to the invention has an internal structure according to the invention, which is arranged in the interior of a tubular metal sheathing and is insulated from this sheathing by an electrically insulating material.

The electrically insulating material is preferably impregnated. For example, impregnated magnesium oxide powder could be used.

According to one especially preferred embodiment of the invention, the outer contour of the tubular metal sheathing is adapted to the outer contour of the internal structure, which enables, in particular, an especially direct and targeted dissipation of heat to the environment.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
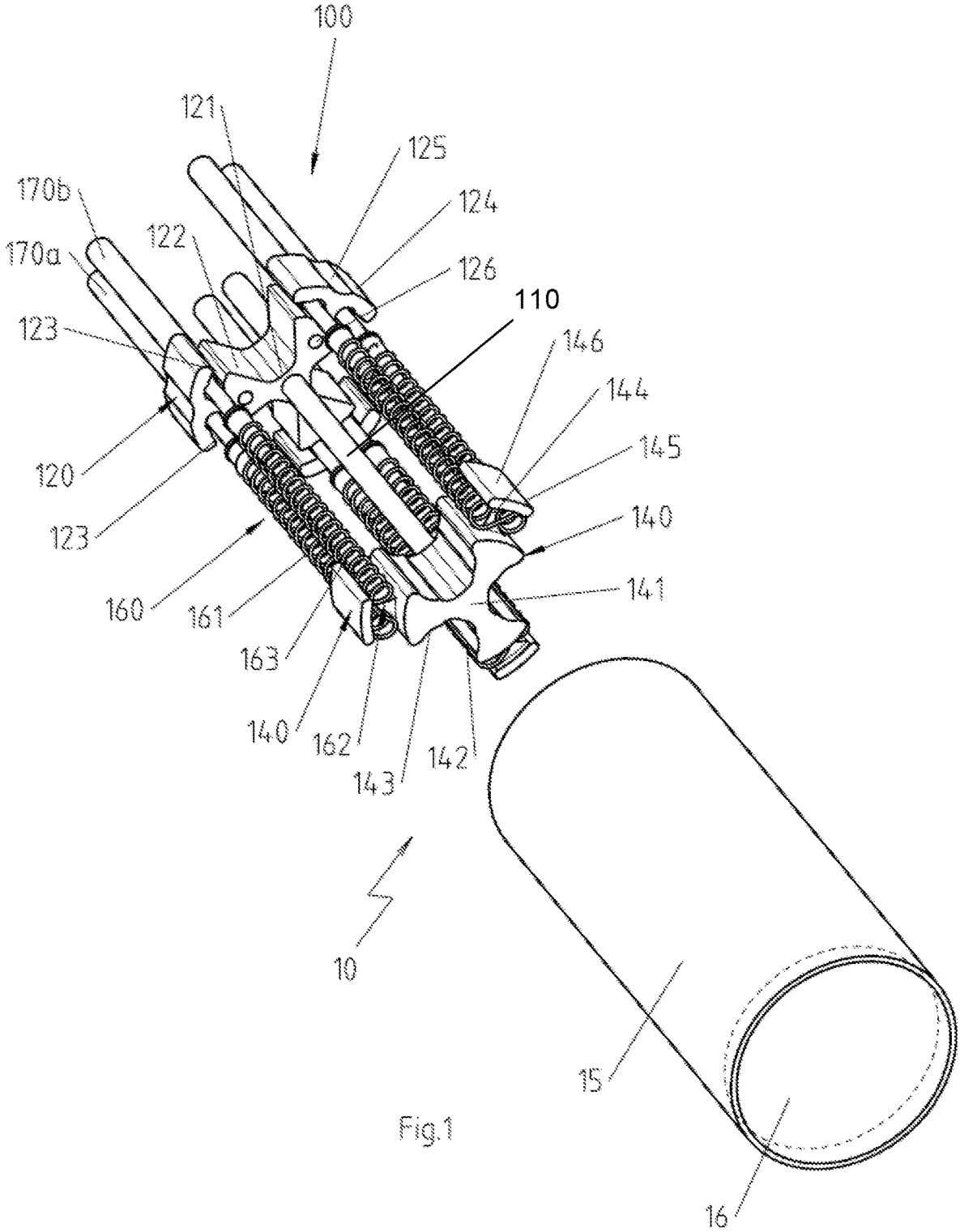
FIG. 1 is a top perspective view of a first preferred electrical heating device in a partial exploded-view illustration.

FIG. 1 shows an electrical heating device 10 in a partial exploded-view illustration, in which are visible the tubular metal sheathing 15, which is a cylindrical sheathing with base 16 in the shown embodiment and the internal structure 100 for the electrical heating device 10, which is actually arranged in a powdery material that is electrically insulating but has good thermal conductivity properties, such as, e.g., magnesium oxide embedded within the tubular metal sheathing 15.

The internal structure 100 has a connection section 120, a turnaround section 140 and a spacer 110 that runs between the connection section 120 and the turnaround section 140. The profile of the here rod-shaped spacer 110 or its center axis between the connection section 120 and turnaround section 140 defines a direction relative to which both the connection section 120 and also the turnaround section 140 top the spacer 110 in the radial direction, wherein the measure of this topping varies as a function of the respective polar angle.

Furthermore, on the internal structure 100, electrical heating element 160 constructed as a resistive wire is arranged, whose end sections are connected in an electrically conductive and mechanical way to connecting wires 170*a*, 170*b*. The connecting wires 170*a*,170*b* are each held in the connection section 120. Starting from the end section connected to the connecting wire 170*a*, there follow a first freely coiled area 161, a turnaround area 162, and a second freely coiled area 163 of the electrical heating element 160, before it is connected in its second end section to the connecting wire 170*b*.

The basic geometric shapes of the connection section 120 and the turnaround section 140 are essentially identical in this preferred embodiment. Both have a middle area 121 and 141, respectively, in whose center they are connected detachably or permanently to the spacer 110. Starting from the middle area 121 and 141, three arms 122 and 142, respectively, extend outward in the radial direction, so that a three-count rotational symmetry is produced with respect to the center axis.

This basic geometric shape is varied in different ways by different shaping of the arms 122 and 142.

The arms 122 of the connection section 120 essentially have a circular sector-shaped design. They each have slots 123 in which the connecting wires 170*a*,170*b* are inserted and held from the side in the circumferential direction. This can be realized, in particular, such that the connecting wires 170*a*,170*b* locally have a larger cross section than the dimensions of the slots 123, as can be seen by comparing the sections of the connecting wires 170*a*,170*b* located on different sides of the connection section 120, so that this larger cross section is supported on the connection-side surface of the connection section 120. In this way, in particular, a defined mechanical stress on the electrical heating element 160 can be achieved.

The end surfaces of the arms 122 of the connection section 120 are used as support surfaces 124, with which the internal structure 100 is supported on the tubular metal sheathing 15 of the electrical heating device 10. By means of the groove 125 present in the support surfaces 124 and holes 126, the filling of electrically insulating material into the volume that is still empty after the internal structure 100 has been inserted in the tubular metal sheathing 15 is also made easier or improved in the areas of the arms 122 of the connection section 120.

The arms 142 of the turnaround section 140 each have three sections: a section 143 that becomes wider outward in the radial direction, a connecting bar 144 that runs in the radial direction and provides the turnaround area 162 for the electrical heating element 160, and a lug 145 that becomes wider relative to the connecting bar 144 and whose end side forms a support surface 146, with which the internal structure 100 is supported on the tubular metal sheathing 15 of the electrical heating device 10.

Figure 2:
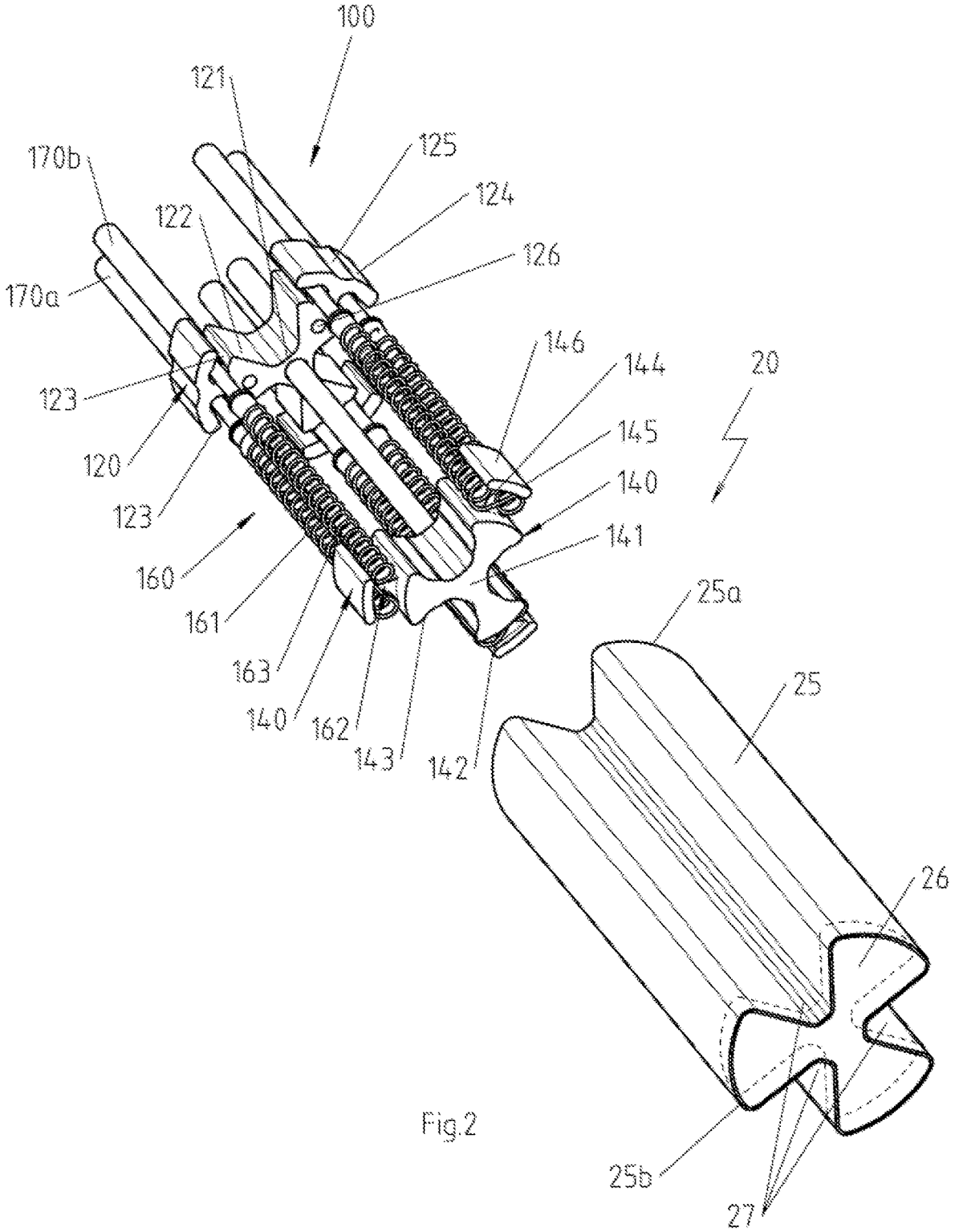
FIG. 2 is a top perspective view of a second preferred electrical heating device in a partial exploded-view illustration.

The electrical heating device 20 shown in FIG. 2 of a second preferred embodiment differs from the electrical heating device 10 of the first preferred embodiment only by the tubular metal sheathing 25 that is used, while the internal structure 100 is the same internal structure as shown in FIG. 1, which is why it can be omitted there. The tubular metal sheathing 25 with base 26 has three recesses 27 that extend in the profile direction of the tubular metal sheathing 25 from its one end surface 25*a* to its other end surface 25*b*, on which the base 26 is located. Because the sheathing thickness of the tubular metal sheathing 25 is constant, the outer contour and the inner contour of the tubular metal sheathing 25 are adapted to the outer contour of the internal structure 100, and there is a larger surface available for heat dissipation.

The internal structures 200, 300, 400, 500 shown in FIGS. 3 to 6 have, just like the inner structure 100, a spacer 210, 310, 410, 510 that runs between a connection section 220, 320, 420, 520 and a turnaround section 240, 340, 440, 540.

Figure 3:
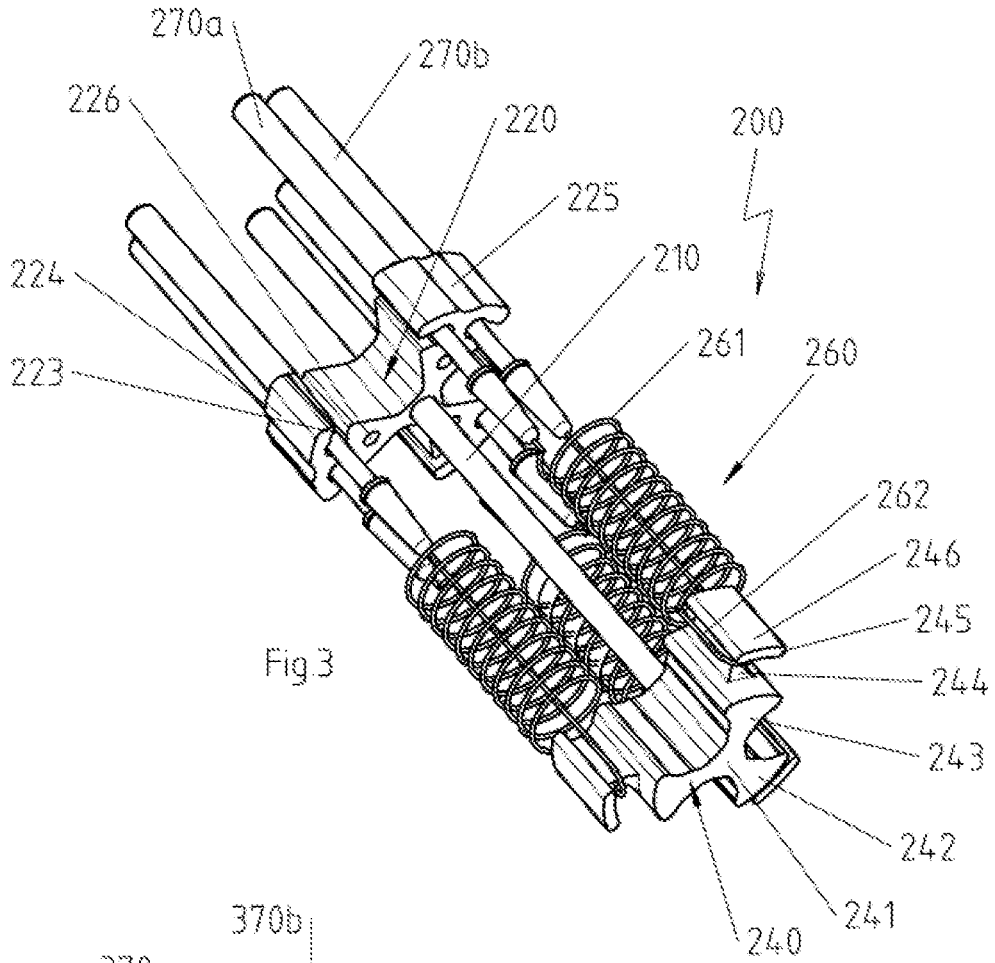
FIG. 3 is a top perspective view of an internal structure for the electrical heating device of FIG. 1 or 2.
Figure 4:
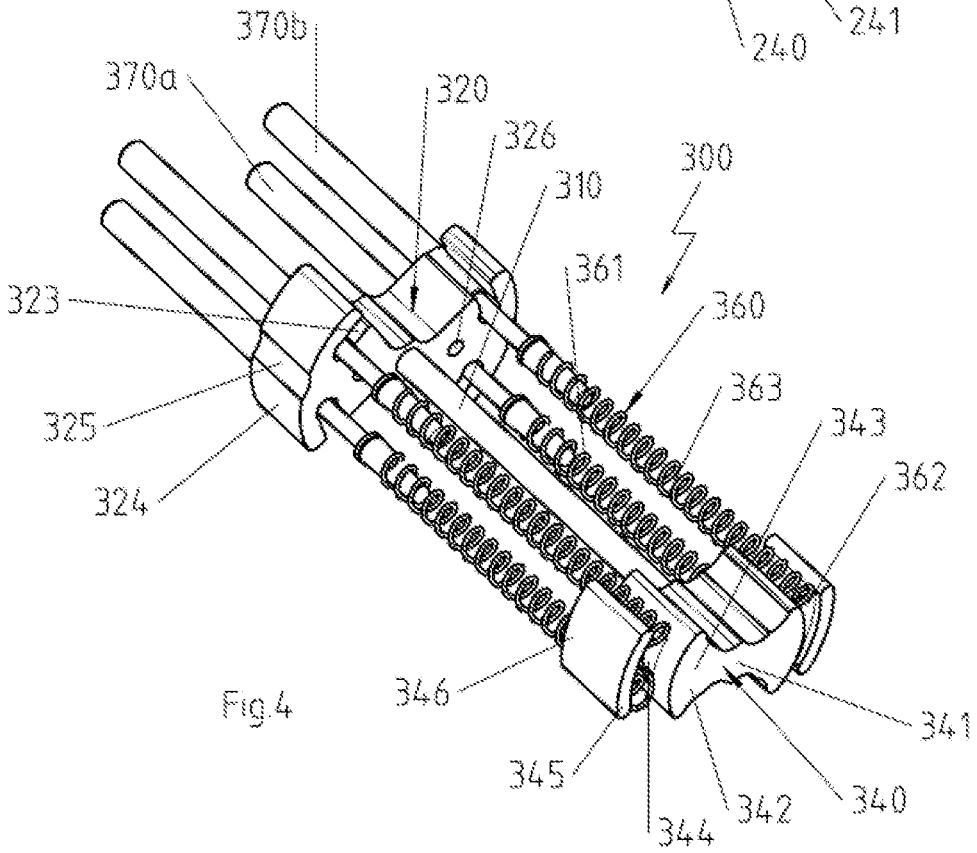
FIG. 4 is a top perspective view of an internal structure for the electrical heating device of FIG. 1.

In FIGS. 3 and 4, the geometry of the individual arms 222, 242 and 322, 342, respectively, is shaped exactly like that of the arms 122, 142 in the internal structure 100 of FIG. 1, from whose description the corresponding reference symbol for the arms 222 of FIG. 3 is given by the addition of 100 and the reference symbol for the arms 322 of FIG. 4 is given by the addition of 200.

The internal structure 200 according to FIG. 3 differs from the internal structure 100 on one hand in that the spacer 210 passes centrally through the connection section 220 and extends over it on the connection side. If the connection section 220 has a design so that it can be moved and fixed in a desired position—for example, by means of a set screw or a locking mechanism, then on one hand a variable mechanical stress on the electrical heating elements 260 can be realized and on the other hand simple finishing can be achieved.

On the other hand, the profile of the electrical heating element 260 that has the internal structure 200 as resistive wire differs from the internal structure 100. Indeed, in both cases there are three electrical heating elements 260 or 160, but in contrast to the electrical heating elements 160, the electrical heating elements 260 have only one freely coiled section 261 that is connected on its one side to a connecting wire 270*a* held in the connection section 220 and extends on its other side into a long connecting area 262 that is guided and turned around by means of a connecting bar 244 of the turnaround section 240, so that it runs through the coils of the freely coiled section 261 back in the direction toward the connection section 220 and is electrically contacted to a second connecting wire 270*b* held in this section.

The internal structure 300 according to FIG. 4 differs from the internal structure 100 according to FIG. 1 only with respect to the number of arms 322. Obviously, internal structures can also be produced that have more than three arms.

Figure 5:
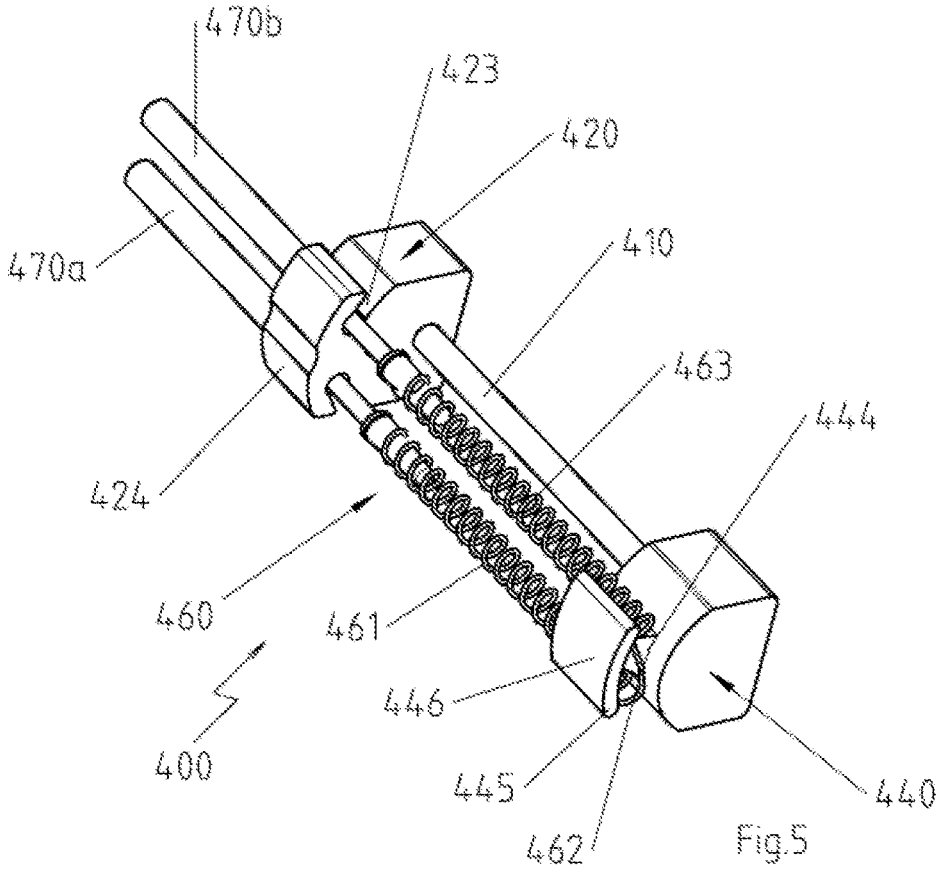
FIG. 5 is a top perspective view of an internal structure for an electrical heating device of FIG. 1 or 2.

The internal structure 400 according to FIG. 5 differs from the internal structure 100 in that it has only one arm 422 on the connection section 420 and only one arm 442 on the turnaround section 440 and there is only one electrical heating element 460. In addition, the geometry of the arms 422 and 442 is different than in the embodiments discussed before.

The internal structure 400 provides an asymmetrically arranged electrical heating element 460, whose end sections are connected in an electrically conductive and mechanical way with connecting wires 470*a*, 470*b* that are suspended and thus held as previously described in slots 423 provided in the arm 420 of the connection section.

Starting from the end section connected to the connecting wire 470*a*, there follow a first freely coiled area 461, a turnaround area 462 that is provided by means of a connecting bar 444 of the turnaround section 440 running in the radial direction, and a second freely coiled area 463 of the electrical heating element 460, before it is connected in its second end section to the connecting wire 470*b*. As in the internal structure 100, here the end surfaces of the arms 420 and 440 are also used as support surfaces 424 and 446, respectively.

Figure 6:
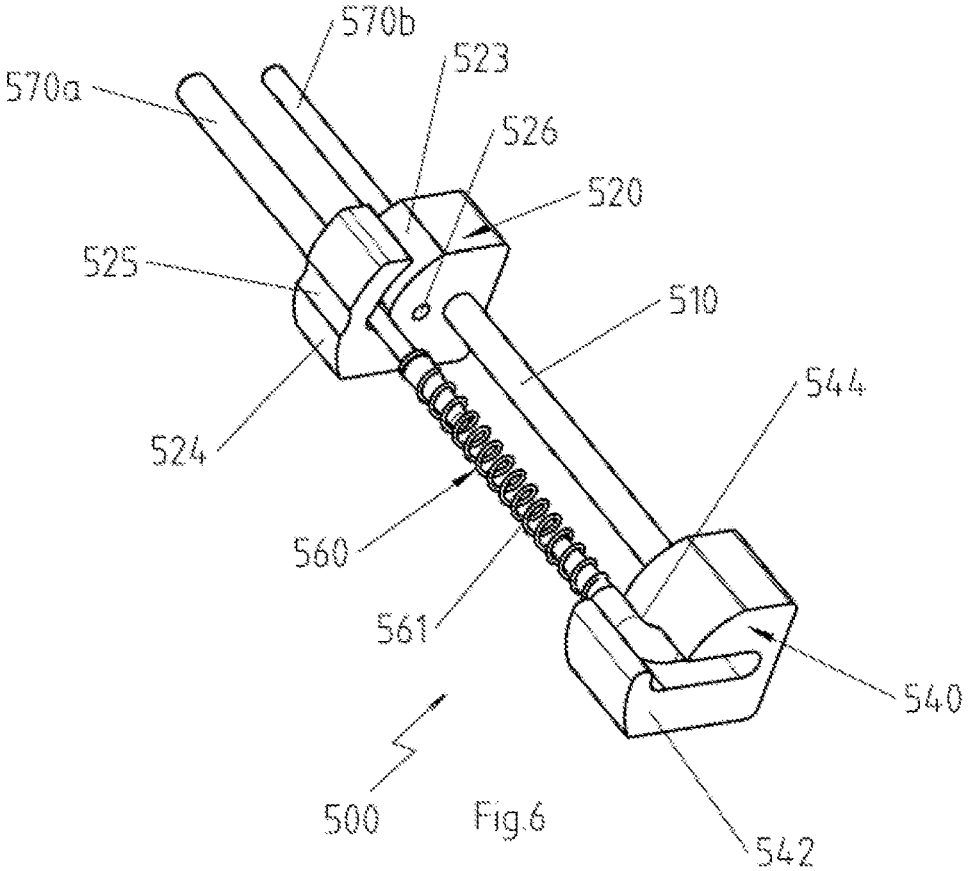
FIG. 6 is a top perspective view of an internal structure for an electrical heating device of FIG. 1 or 2.

The internal structure 500 according to FIG. 6 is similar to the internal structure 400 from FIG. 5, but they differ in two aspects. First, here the spacer 510 is formed by a section of a connecting wire 570*b*. Second, it is not the electrical heating element 560 that is turned around at the turnaround section 540 and has, starting from an end section connected to the connecting wire 570*a*, only one freely coiled area 561 and is connected with its second end section to the connecting wire 570*b*, but instead the connecting wire 570*b*, and indeed by means of a connecting bar 544 that separates two passage openings for the connecting wire 570*b* from each other for the arm 542.

It is understood that the connection sections and turnaround sections of all embodiments are each preferably made from an electrically insulating material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. An internal structure for an electrical heating device having an electrical heating element freely coiled at least in sections, wherein the internal structure comprises:

a connection section for holding at least one of two end sections of the electrical heating element freely coiled at least in sections and/or at least one connecting wire, with which at least one of the two end sections of the electrical heating element freely coiled at least in sections is connected, a turnaround section that is arranged opposite the connection section and at which the electrical heating element freely coiled at least in sections and/or the at least one connecting wire is turned around, with the at least one connecting wire being connected to at least one of the two end sections of the electrical heating element freely coiled at least in sections is connected, the turnaround section including a middle area and a connecting bar extending radially outwardly from the middle area, and a spacer that runs between the connection section and the turnaround section and is topped at least by the turnaround section at least in a radial direction relative to a profile of the spacer, wherein the electrical heating element freely coiled and/or the at least one connecting wire is turned around at the connecting bar, with the at least one connecting wire being connected to at least one of the two end sections of the electrical heating element freely coiled at least in sections.

2. The internal structure according to claim 1, wherein the connecting bar runs from the profile of the spacer in the radial direction.

3. The internal structure according to claim 1, wherein the electrical heating element freely coiled and/or the at least one connecting wire, with which at least one of the two end sections of the electrical heating elements freely coiled at least in sections is connected, is supported on the connection section so that a freely coiled section of the electrical heating element is tensioned.

4. The internal structure according to claim 1, wherein the connection section has at least one slot in which a section of the electrical heating element freely coiled and/or the at least one connecting wire is held.

5. The internal structure according to claim 1, wherein the turnaround section has, a lug at a distal end of the connecting bar for preventing slippage of the electrical heating element freely coiled and/or the at least one connecting wire.

6. The internal structure according to claim 1, wherein the connection section and/or the turnaround section has support surfaces for supporting internal structure on tubular metal sheathing of the electrical heating device.

7. The internal structure according to claim 1, wherein a position of the connection section and/or the turnaround section on the spacer is variable and there are fixing agents for fixing the connection section and/or the turnaround section.

8. The internal structure according to claim 1, wherein the at least one connecting wire forms the spacer.

9. The internal structure according to claim 1, wherein at least one of a controller, a sensor, and a detecting element is installed in the spacer or mounted on the spacer.

10. The internal structure according to claim 1, wherein the electrical heating element includes multiple electrical heating elements freely coiled at least in sections.

11. The internal structure according to claim 10, wherein at least some of the multiple electrical heating elements freely coiled at least in sections are separated galvanically and/or have different heat outputs and/or can be switched individually.

12. The internal structure according to claim 1, wherein the electrical heating element freely coiled at least in sections is connected in series with a thermal fuse.

13. The internal structure according to claim 1, wherein the internal structure is arranged in an interior of a tubular metal sheathing and is insulated from the tubular metal sheathing by an electrically insulating material.

14. The internal structure according to claim 13, wherein the electrically insulating material is impregnated.

15. The internal structure according to claim 13, wherein one of an outer contour and an inner contour of the tubular metal sheathing is adapted to an outer contour of the internal structure.

* * * * *